US005614995A

United States Patent [19]

Jaskowiak et al.

[11] Patent Number: 5,614,995

[45] Date of Patent: Mar. 25, 1997

[54] ELECTRODED DONOR ROLL HAVING ROBUST COMMUTATOR CONTACTS

[75] Inventors: Timothy R. Jaskowiak, Webster; Julie A. Perez, Pittsford; Ann M. Kazakos, Webster; Daniel R. Gilmore, III, Victor; Jay L. Schneider, Canandaigua; Heiko Rommelmann, Webster, all of N.Y.

[73] Assignee: Xerox Corporation, Stamford, Conn.

[21] Appl. No.: 523,457

[22] Filed: Sep. 5, 1995

[51] Int. Cl.[6] ..... G03G 15/06

[52] U.S. Cl. ..... 399/385

[58] Field of Search ..... 355/247, 251, 355/259, 261–265; 118/647, 648, 654, 649–651

[56] References Cited

U.S. PATENT DOCUMENTS

| | | | |
|---|---|---|---|
| 3,257,224 | 6/1966 | Jöns et al. | 118/653 X |
| 3,996,892 | 12/1976 | Parker et al. | 118/658 |
| 5,172,170 | 12/1992 | Hays et al. | 355/259 |
| 5,394,225 | 2/1995 | Parker | 355/259 |
| 5,413,807 | 5/1995 | Duggan et al. | 427/58 |
| 5,515,142 | 5/1996 | Rommelmann | 355/259 |
| 5,517,287 | 5/1996 | Rodriguez et al. | 118/648 X |
| 5,523,826 | 6/1996 | Jugle | 355/259 |

*Primary Examiner*—Shuk Yin Lee

[57] ABSTRACT

An electroded donor roll for mounting partially within a mixing chamber of a development unit for forming a development zone with an image bearing member and moving charged toner particles from the mixing chamber to the development zone. The donor roll includes a conductive shaft core and a dielectric material layer that is injection molded over the shaft core. The donor roll also includes axially extending electrodes formed in the surface of the dielectric layer, and robust commutator contact pads that are formed from a conductive commutator washer device which has been overmolded into the dielectric layer. The commutator pads each are in line with, and contact an axially extending electrode.

10 Claims, 6 Drawing Sheets

ELECTRODED DONOR ROLL HAVING ROBUST COMMUTATOR CONTACTS

This invention relates generally to electrostatographic reproduction machines, and more particularly concerns a scavengeless development apparatus including an electroded donor roll having overmolded robust commutator contacts.

Generally, the process of electrostatographic reproduction includes uniformly charging a photoconductive member, or photoreceptor, to a substantially uniform potential, and imagewise discharging it or exposing it to light reflected from an original image of a document being reproduced. The result is an electrostatically formed latent image on the photoconductive member. The latent image is then developed by bringing a charged developer material into contact therewith. Two-component and single-component developer materials are commonly used. A typical two-component developer material comprises magnetic carrier particles, also known as "carrier beads," having charged toner particles adhering triboelectrically thereto. A single component developer material typically comprises charged toner particles only. In either case, the charged toner particles when brought into contact with the latent image, are attracted to such image, thus forming a toner particle image on the photoconductive member. The toner particles image is subsequently transferred to a receiver sheet which is then passed through a fuser apparatus where the toner particles image is heated and permanently fused to the sheet forming a copy of the original image.

In etectrostatographic reproduction machines for making copies of highlight or full-color images, latent images of color components thereof are formed as above on a photoreceptor, and developed with different color toner particles. The color component images of different color toners may be formed as such in successive and superimposed registration on the photoreceptor, thus forming the desired colored image on the photoreceptor prior to transferring to a receiver sheet.

A significant problem encountered with performing such pre-transfer successive development steps is that a succeeding development step may interfere with, or "scavenge," toner particles which had been attracted to the photoreceptor in a previous developing step. There has thus been a need for development apparatus and techniques which do not cause such interference, that is, apparatus and techniques that can be said to be "scavengeless."

One type of scavengeless development apparatus uses a donor roll for transporting charged toner particles to the development zone of the apparatus. A plurality of electrode wires are closely spaced to the donor roll in the development zone. An AC voltage is applied to the electrode wires for forming a toner cloud in the development zone. The electrostatic fields generated by the latent image attract charged toner particles from the toner cloud thus developing the latent image. A hybrid version of such a scavengeless development apparatus employs a magnetic brush developer roller (magnetic roller) for transporting from a sump to the donor roll, magnetic carrier beads which have charged toner particles adhering triboelectrically thereto. The charged toner particles are attracted from the carrier beads on the magnetic roller to the donor roll. In the development zone, the electrically biased electrode wires then detach the charged toner particles from the donor roll, thereby forming a toner powder cloud in the development zone for developing latent images as above.

A key variation to the powder-cloud-creation techniques which are the essence of scavengeless development is scavengeless electroded development (SED) in which electrodes, are not spaced from the donor roll, but rather are embedded within the donor roll. U.S. Pat. No. 5,172,170, assigned to the assignee of the present application, discloses a scavengeless development apparatus in which a set of longitudinally-disposed electrodes are mounted on or embedded in a rotating donor roll. A contact brush is used as a commutator application device to energize those electrodes in the development zone of the development apparatus. When the electrodes are energized, AC electric fields are formed between adjacent electrodes. The electric fields then cause charged toner particles near the electrodes to jump off the donor roll forming the powder cloud for latent image development within the development zone.

U.S. Pat. No. 3,257,224 discloses an apparatus for developing electrostatic images in which a developer roller transports both toner and a magnetic carrier. The roller is made up of rotor plates having windings to which current is supplied intermittently, and an outer cover of an insulating plastic material. The purpose of the electromagnetic windings within the roller is to attract developer material from a sump to the surface of the roller. The electromagnetism is cut off only to clean the roller and recycle the developer, after the given portion of the surface exits the development zone.

U.S. Pat. No. 3,996,892 granted to Parker et al on Dec. 14, 1976 discloses a spatially programmable electroded donor roll wherein a DC voltage is applied to the wire electrodes in the development nip or zone, pre-nip and post-nip zones through commutating brushes at the ends of the donor roll. Such an arrangement allows the bias profile around the circumference of a two component magnetic brush development roll to be tailored in a way that promotes good development. The electrodes on the donor roll were constructed by first plating a thin layer of copper on the outer surface of a phenolic roll, and then by etching 0.01" wide electrode strips, on 0.02 centers, axially along the length of the roll. Next, the roll was overcoated with a semi-conductive rubber sheath, except for a short length at the ends where the bias was applied to the electrodes through a commutating brushes. Such a construction is known to have had problems with wear and pitting of the thin electrodes where they made contact with the commutating brushes.

The '892 patent, in a second embodiment, discloses the use of a ring-like resistive member mounted for rotation with a donor roll. A plurality of stationarily mounted electrical contacts ride on the ring-like member which, in turn, is seated on the coating free portions of conductors and mounted for rotation with a sleeve upon which the conductors are carried.

U.S. Pat. No. 5,394,225 issued Feb. 28, 1995 to Parker, and commonly assigned, discloses a non-interactive or scavengeless development system for use in color imaging. To control the developability of lines and the degree of interaction between the toner and receiver, an AC voltage is applied between a donor roll and two sets of interdigitated electrodes embedded in the surface of the donor roll to enable efficient detachment of toner from the donor to form a toner cloud. An optical switching arrangement effects an electrical connection between a slip ring and one set of interdigitated electrodes In the '225 patent, to minimize wear and tear on the embedded electrodes one set of the interdigitated wire electrodes makes contact with a continuous slip ring at one end of the donor roll. The other set of electrodes is electrically connected to the source of power through a commutator member which makes rolling contact with the electrodes thereof.

In another embodiment of the '225 patent, the brush contact is made on the interior surface of the donor roll. To this end, the electrode wires are brought into the interior of the donor roll using printed circuit techniques.

U.S. Pat. No. 5,413,807 issued May 9, 1995 to Duggan et al. discloses a method of manufacturing electroded donor rolls that have electrodes screened onto the surface, and electrode contacts coated at one end of the donor roll surface.

In each scavengeless electroded development (SED) apparatus as disclosed for example above, common disadvantages encountered with the donor roll are clearly wear and tear on, as well as, contamination of the plated electrode contacts, usually resulting in shortened life and relatively less reliable commutation.

SUMMARY OF THE INVENTION

In accordance with one aspect of the present invention, there is provided an electroded donor roll for mounting partially within a mixing chamber of a development unit for forming a development zone with an image bearing member and moving charged toner particles from the mixing chamber to the development zone. The donor roll includes a shaft core and a dielectric material layer that is injection molded over the shaft core. The donor roll also includes axially extending electrodes formed in the surface of the dielectric layer, and robust commutator contact pads that are formed from a conductive commutator washer device which has been overmolded into the dielectric layer. The commutator pads each are in line with, and contact an axially extending electrode.

In accordance with another aspect of the present invention, there is provided a development unit for developing a latent image recorded on an image bearing member. The development unit includes a housing defining a mixing chamber for mixing and charging a supply of magnetizable two-component developer material containing charged toner particles, and means mounted within the mixing chamber for moving developer material thereabout. The development unit also includes a rotatable electroded donor roll mounted partially within the mixing chamber forming a development zone with an image bearing member for moving charged toner particles from the mixing chamber to the development zone. The donor roll includes a shaft core, a dielectric layer injection molded over the shaft core, axially extending electrodes formed in the surface of the dielectric layer, and robust commutator contact pads formed from a conductive commutator washer device overmolded into the dielectric layer.

BRIEF DESCRIPTION OF THE DRAWINGS

Other features of the present invention will become apparent as the following description precedes and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 6 printing machine will be shown hereinafter only schematically and their operation described only briefly with reference thereto.

Figure 6:
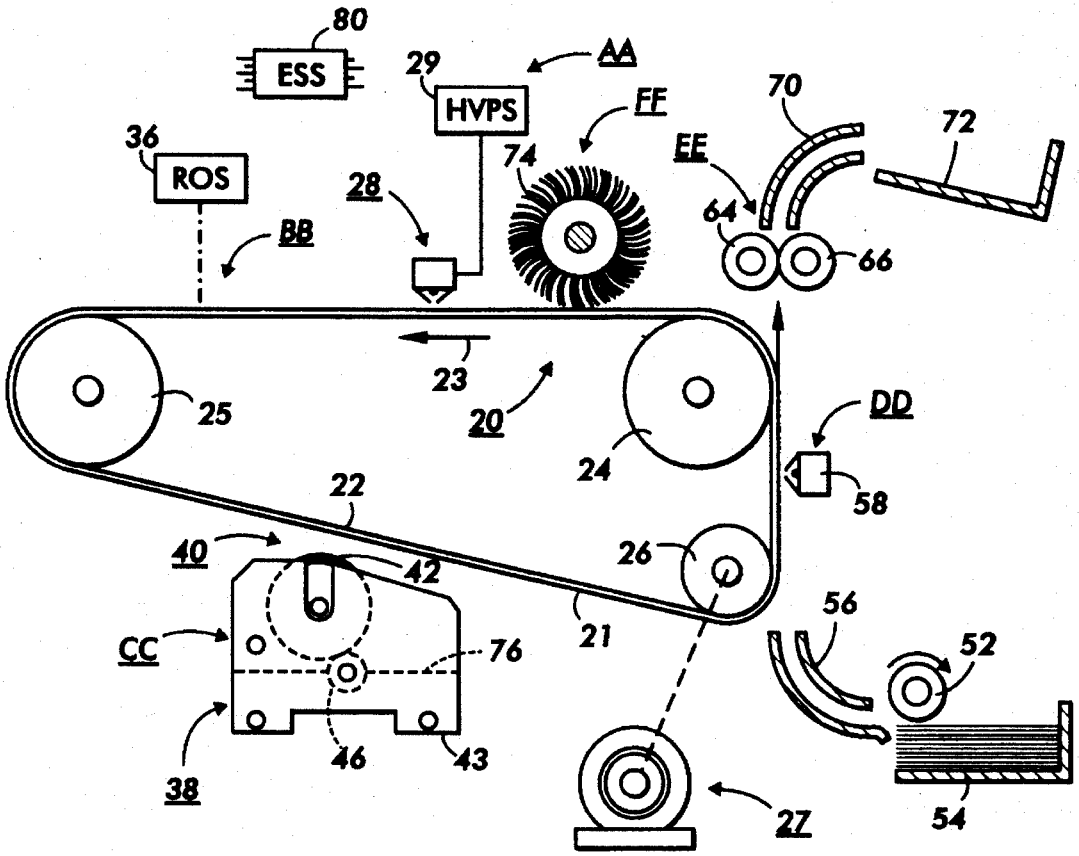
FIG. 6 is a schematic elevational view of an illustrative electrostatographic reproduction machine incorporating the development apparatus of the present invention.

Referring initially to FIG. 6, there is shown an illustrative electrophotographic reproduction machine incorporating the development apparatus or unit of the present invention. The reproduction machine incorporates a photoreceptor 20 in the form of a belt having a photoconductive surface layer 21 on an electroconductive substrate 22. Preferably the surface 21 is made from a selenium alloy. The substrate 22 is preferably made from a conductive material which is electrically grounded. The belt is driven by means of motor 27 along a path defined by rollers 24, 25 and 26, the direction of movement being counter-clockwise as viewed and as shown by arrow 23.

Initially a portion of the belt 20 passes through a charge station AA at which a corona generator 28 charges surface 21 to a relatively high, substantially uniform, potential. A high voltage power supply 29 is coupled to device 28.

Next, the charged portion of photoconductive surface 21 is advanced through exposure station BB. At exposure station BB, a ROS 36 lays out the image in a series of horizontal scan lines with each line having a specified number of pixels per inch. The ROS 36 includes a laser having a rotating polygon mirror block associated therewith. The ROS exposes the charged photoconductive surface of the reproduction machine.

After the electrostatic latent image has been recorded on photoconductive surface 21, belt 20 advances the latent image to development station CC where a development unit 38 (such as the hybrid electroded development unit of the present invention, to be described in detail below), develops the latent image recorded on the photoconductive surface.

Still referring to FIG. 6, after the electrostatic latent image has been developed, belt 20 advances the developed image to transfer station DD, at which a copy sheet 54 is advanced by roll 52 and guides 56 into contact with the developed image on belt 20. A corona generator 58 is used to spray ions onto the back of the sheet so as to attract the toner image from belt 20 to the sheet. As the belt turns around roller 24, the sheet is stripped therefrom with the toner image thereon.

After transfer, the sheet is advanced by a conveyor (not shown) to fusing station EE. Fusing station EE includes a heated fuser roller 64 and a back-up roller 66. The sheet passes between fuser roller 64 and back-up roller 66 with the toner powder image contacting fuser roller 64. In this way, the toner powder image is fused and permanently affixed to the sheet. After fusing, the sheet advances through chute 70 to catch tray 72 for subsequent removal from the reproduction machine by an operator.

In the process as described above, after the sheet is separated from photoconductive surface 21 of belt 20, residual toner particles adhering to photoconductive surface 21 are removed therefrom at cleaning station FF for example by a rotatably mounted fibrous brush 74 in contact with photoconductive surface 21. Subsequent to cleaning, a discharge lamp (not shown) floods photoconductive surface 21 with light to dissipate any residual electrostatic charge remaining thereon prior to the charging thereof for the next successive imaging cycle.

As is well known, the reproduction machine may include an electronic control subsystem or ESS 80 for controlling the various components and operating subsystems of the machine. ESS 80, for example, may be a self-contained dedicated minicomputer. As such, it may include at least one, and may be several programmable microprocessors for handling all control data including control signals from sensors for the various controllable aspects of the machine.

It is believed that the foregoing description is sufficient for purposes of the present application to illustrate the general operation of an electrophotographic reproduction machine incorporating the development apparatus of the present invention.

Figure 1:
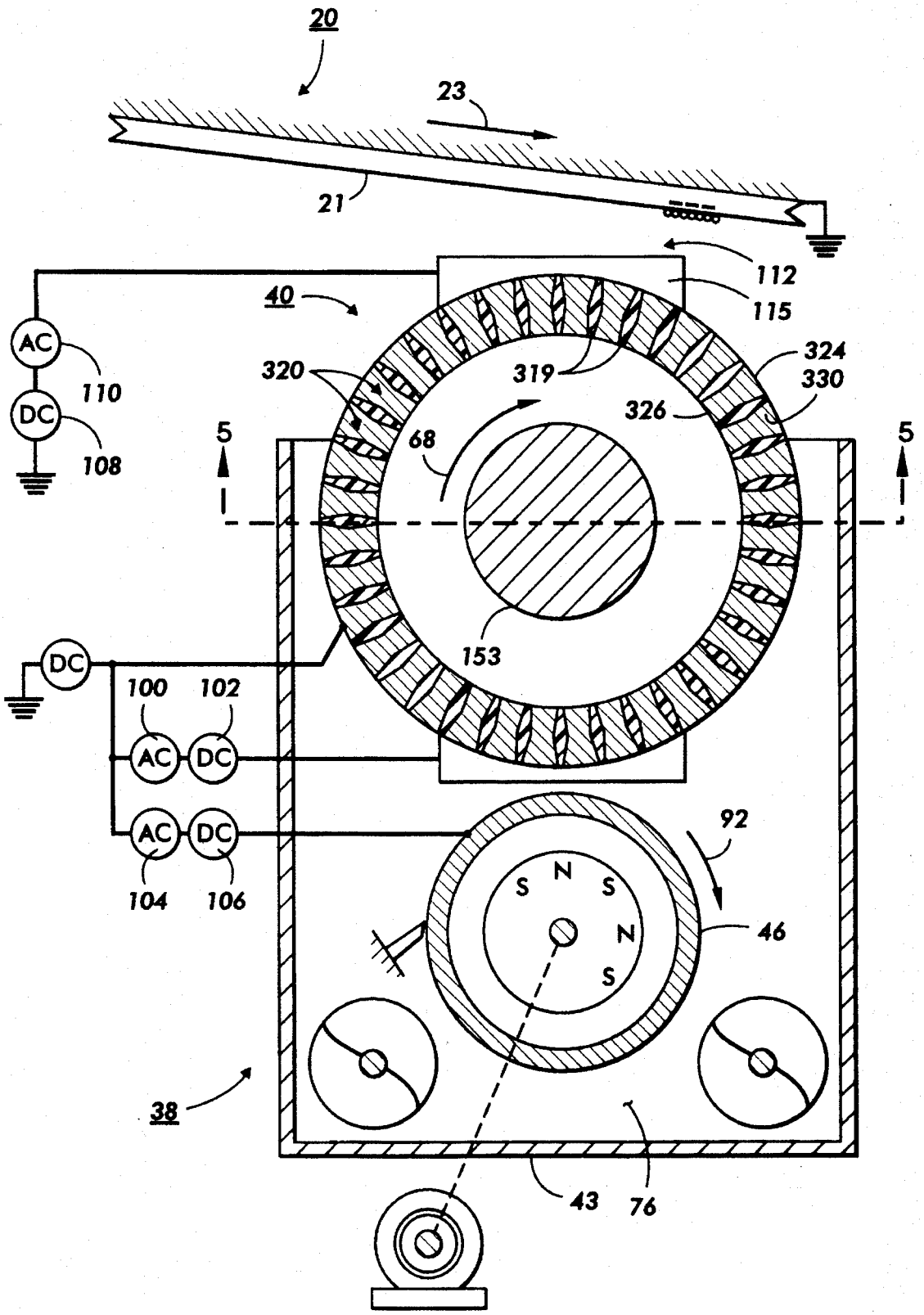
FIG. 1 is a schematic elevational view of a development unit incorporating a donor roll according to the present invention.
Figure 2:
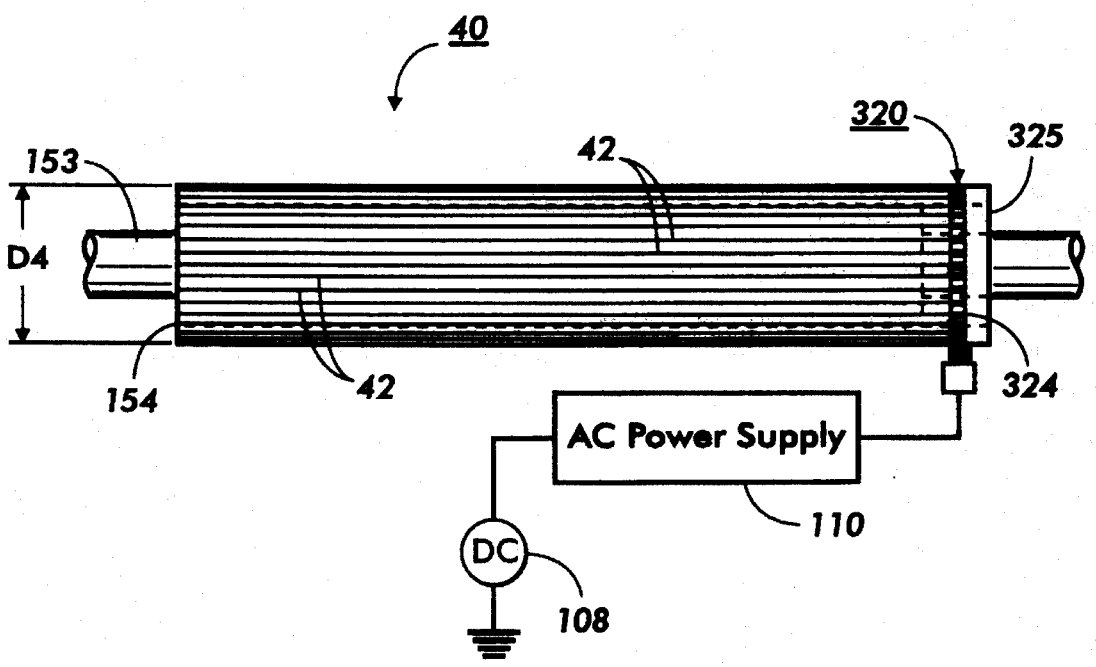
FIG. 2 is a side view of the donor roll of the hybrid development unit of FIG. 1 including robust commutator contacts according to the present invention.

Referring now to FIGS. 1 and 2, there is shown the development unit 38 and donor roll 40 of the present invention in greater detail. Development unit 38 includes a housing 43 defining a developer sump or chamber 76 for storing a supply of developer material. The development unit 38 also includes a donor roll or roller 40 according to the present invention, and electrodes 42 made of electrical conductors embedded or formed on the peripheral circumferential surface of the donor roll 40. Each electrode 42 is aligned with, and contacts a robust commutator contact 320 formed in the donor roll 40 according to the method of the present invention, (to be described in detail below). Electrodes 42 are electrically biased relative to donor roll 40 so as to detach toner therefrom to form a toner powder cloud in the gap or zone 112 between the donor roll 40 and photoconductive surface 21. Image development results when the latent image attracts toner particles from the toner powder cloud forming a visible toner powder image on surface 21. Donor roll 40 is mounted, at least partially, in the sump or chamber 76 of the developer housing 43. The developer material is a two component developer material including charged magnetic carrier granules having charged toner particles adhering triboelectrically thereto. A transport roller 46 disposed interiorly of the chamber 76 is rotatable in the direction of arrow 92 to convey the developer material into a transfer relationship, or to a toner loading zone with the donor roller 40. The transport roller 46 is electrically biased relative to the donor roller 40 so that the toner particles are attracted from the transport roller 46 to the donor roller.

The electrical conductors or electrodes 42 embedded in the donor roll 40 are substantially spaced from one another and insulated from the core of donor roll 40. Donor roll 40 rotates in the direction of arrow 68. An alternating voltage source 100 and a constant voltage source 102 electrically bias donor roll 40 in the toner loading zone. Magnetic roller 46 is electrically biased by AC voltage source 104 and DC voltage source 106. Normally both of these voltages are set to zero. The relative voltages between donor roll 40 and magnetic roller 46 are selected to provide efficient loading of toner from magnetic roller 46 onto donor roll 40 from the carrier granules adhering to magnetic roller 46. Furthermore, reloading of developer material on magnetic roller 46 is also enhanced by such biasing.

In the development zone 112 formed by the donor roll 40 and a latent image bearing photoconductor 20 moving in the direction of arrow 23, voltage sources 108 and 110 electrically bias electrical conductors 42 to a DC voltage supplied by source 108 having an AC voltage 110 superimposed thereon. Voltage sources 108 and 110 are in wiping contact with isolated electrodes 42 in the development zone 112. As donor roll 40 rotates in the direction of arrow 68, successive electrodes 42 advance into development zone 112 and are electrically biased by voltage sources 108 and 110. As shown in FIGS. 1 and 2, each electrode 42 is aligned with and contacts an isolated robust commutator contact pad 320 of the present invention (to be described in detail below). A wiping brush 115 contacts the isolated contact pads 320 as they move through the development zone 112. As illustrated the brush 115 is electrically connected to voltage sources 108 and 110.

The donor roll 40 preferably includes a cylindrically shaped shaft core or substrate 153 made of an electrically conductive material, such as aluminum. The donor roll 40 according to one aspect of the present invention is made by injection molding a suitable plastic material layer 154 over the substrate 153. The substrate or core 153, which is provided in the form of a shaft with journals, is inserted into an injection mold and staged such that the plastic or dielectric layer 154 is injection molded onto the core 153. When the molding operation is complete, the over molded layer and shaft core are then staged on the journals and machined to achieve a required run out and surface finish prior to formation of the electrodes 42 thereon.

The problem addressed by such an injection molding method is the ordinarily high cost and difficulty of manufacturing donor rolls with specific electrical and chemical requirements to meet tight run out and surface finish requirements.

Figure 3:
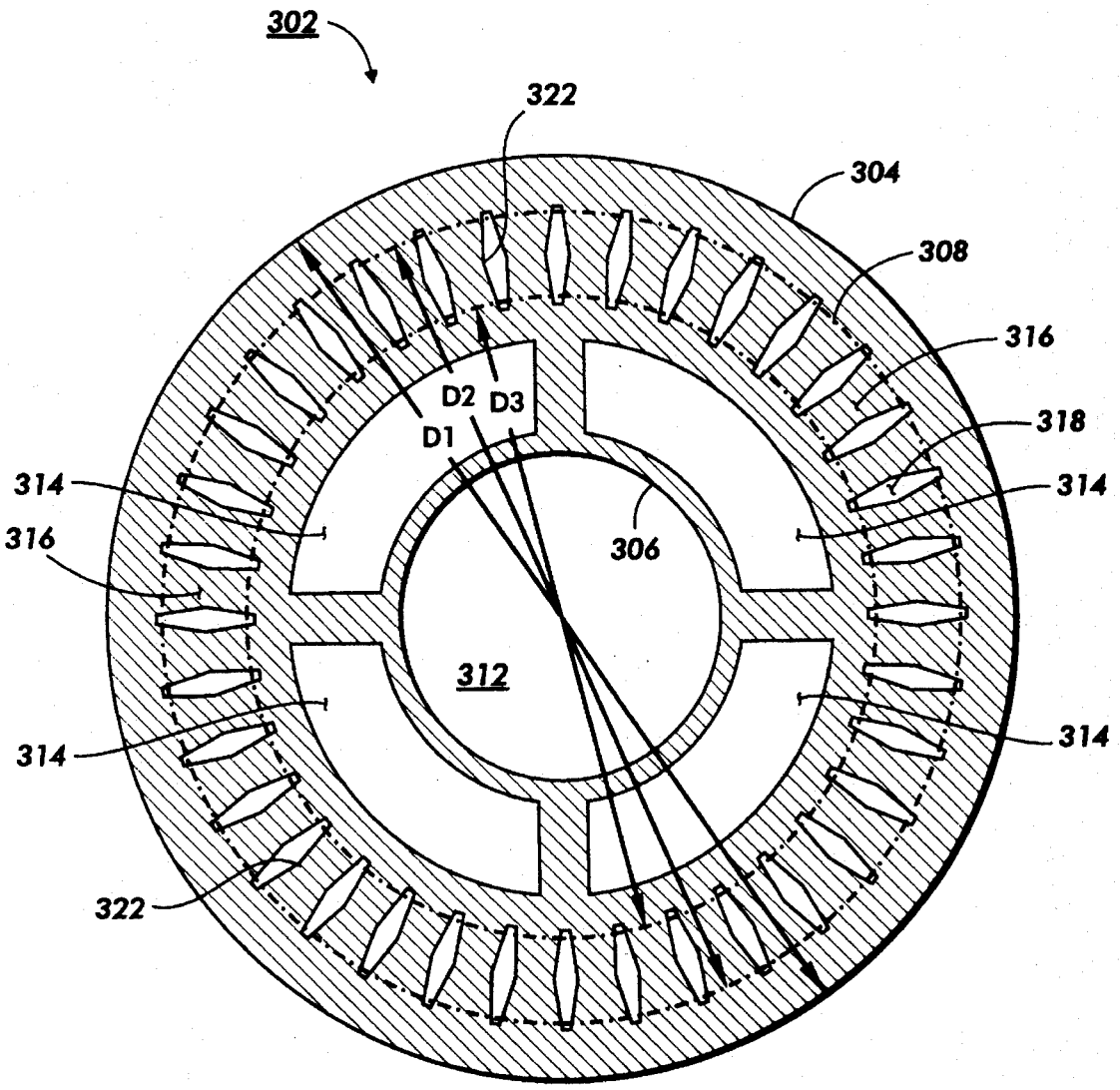
FIG. 3 is a front view of the commutator washer device for forming the robust contacts of the donor roll of FIG. 2.
Figure 4:
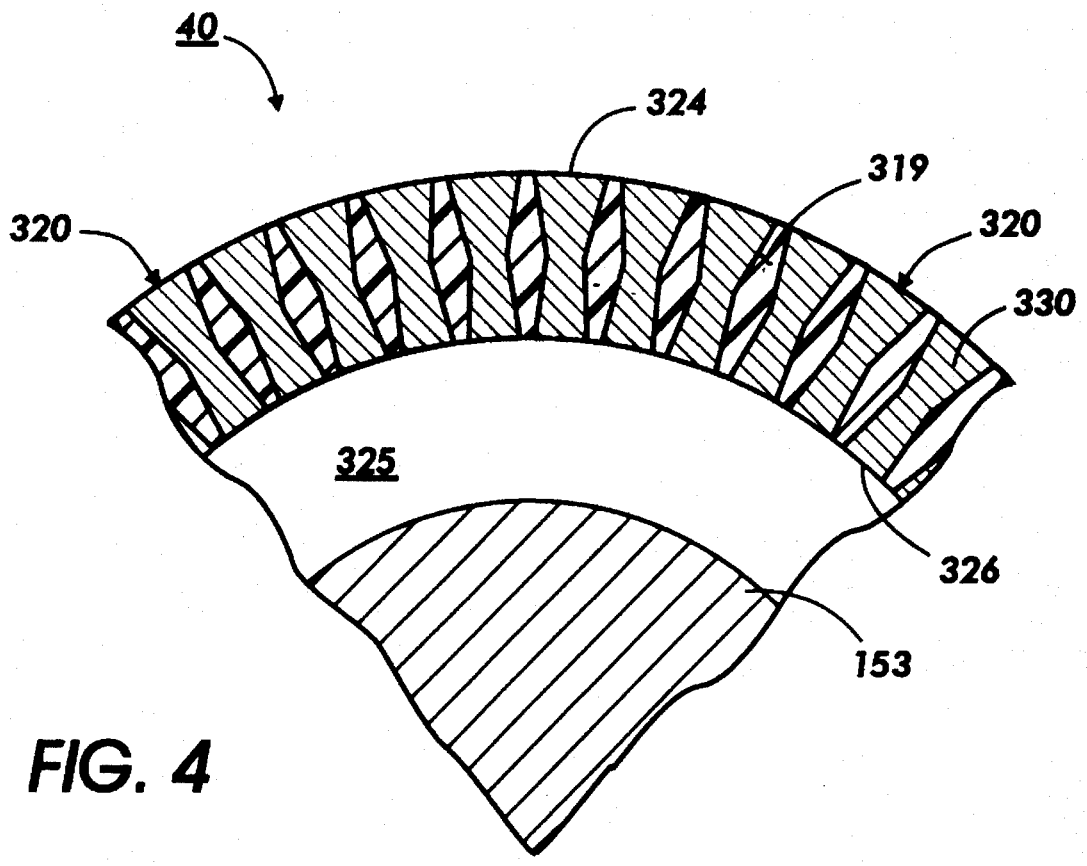
FIG. 4 is an enlarged portion of the washer device of FIG. 3 showing the shape and arrangement of insulated finished contact pads of the donor roll of FIG. 2.
Figure 5:
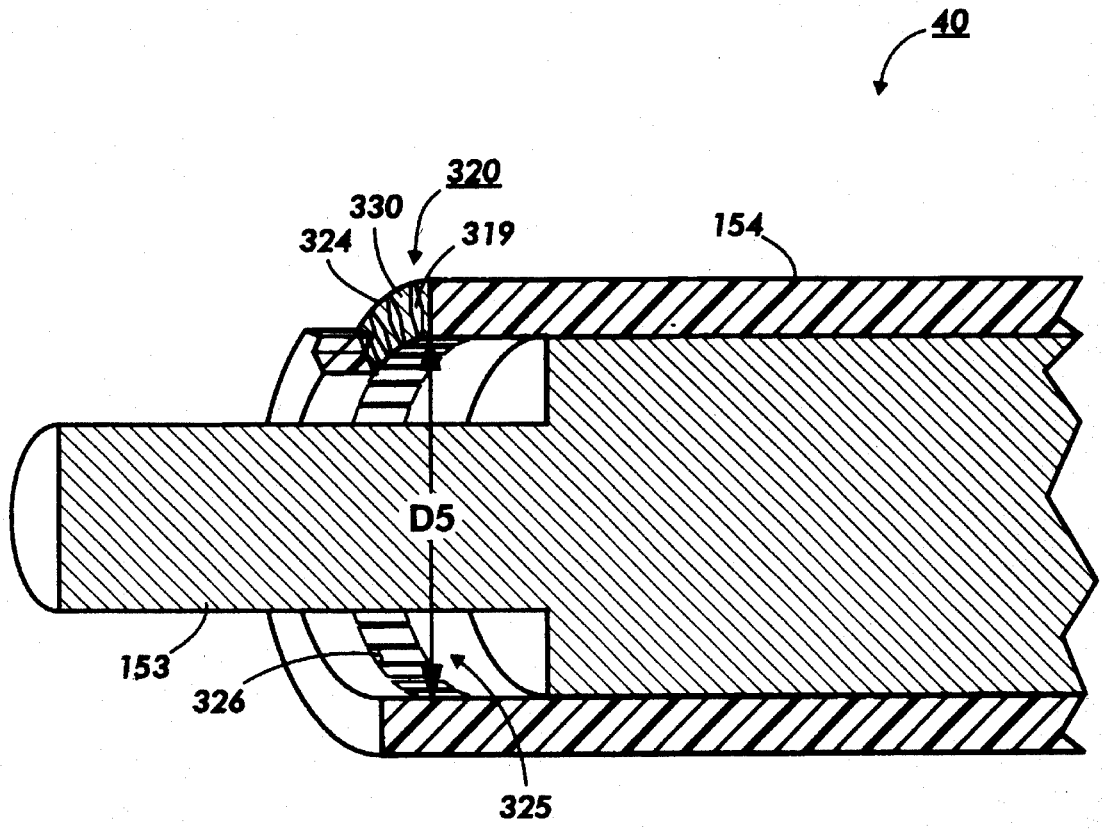
FIG. 5 is a partial sectional view of the commutator contact end of the donor roll of FIG. 2 showing inside surface contacts for inside commutation.

Referring now to FIGS. 3–5, devices and a method for forming the robust commutator contacts 320 of the donor roll 40 are illustrated. To form the finished commutator contacts 320, a conductive commutator washer device 302 is provided. The washer device 302 preferably is made from conductive and preferably metallic material such as copper, and is designed so that when completely formed or over molded into the donor roll 40, it will provide a contact pad for the end of each electrode 42. As shown clearly in FIG. 3, the washer device 302 generally has three radially spaced portions including an outer portion 304, an inner portion 306, and an intermediate portion 308 that connects the outer and inner portions. The outer portion 304 has an outer diameter D1 of about 27.00 mm, and an inner diameter D2 of about 24.99 mm, which is at the same time the outer diameter of the intermediate portion 308. An outer diameter D4 of the sleeve portion of donor roll 40 as determined by the layer 154 should preferably be slightly less than the inner diameter D2 of outer portion 304. As such, outer diameter D1 is thus significantly greater than the sleeve outer diameter D4 of the donor roll 40. This allows the outer portion 304 of washer 302, which is preferably solid with no perforations therein, to fit or mate completely within a location groove of an injection mold for holding the washer device in place during its overmolding into the donor roll 40. An inner diameter D3 of the intermediate portion 308 is about 18.00 mm or such other dimension that results in the radial thickness of the intermediate portion 308 being slightly greater than the thickness of the dielectric layer 154 at the commutator end of the donor roll 40. Such a greater thickness is subsequently machined and reduced to a finished thickness or length of individual commutator pads 320 that is equal to that of the layer 154 at the commutator end of the donor roll, as shown in FIG. 5.

The inner portion 306 of the washer 302 includes a centrally formed opening 312 sufficiently large to fit at least over the journal end of the shaft core 153 of donor roll 40 for staging concentrically in an injection mold prior to injection molding the layer 154 as above. Additionally, the inner portion 306 includes about four slots 314 through the washer for allowing the overmolding plastic material to flow down around the shaft core 153 during molding.

Importantly, the intermediate portion 308 of washer 302 includes a series of radially extending strips 316 of the washer material that are spaced circumferentially by machined or punched out spaces 318. Each strip 316 is connected at its ends to outer portion 304 and to the inner portion 306, respectively, much like radially extending spokes to the rim and hub of a wheel. The outer and inner portions 304, 306 thus serve to hold together these otherwise separated strips 316. The spaces 318 also extend radially only from the inner portion 306, that is, from the inner diameter D3 of the intermediate portion 308, to the inner diameter D2 of outer portion 304. As such, when the outer portion 304 and inner portion 306 are completely machined away after the washer is overmolded into a donor roll 40, each strip 316 will be completely separated and disconnected by a strip 319 of plastic or dielectric material, that forms layer 154, from the adjacent strips 316 so as to form a robust commutator pad 320.

As illustrated in FIGS. 3 and 4, each strip 316 of the intermediate portion 308 includes a narrow portion 322 between its ends 324, 326. The narrow portion 322 may for example be grooves that give each strip 316 an hour-glass shape. During injection molding, molding material flows through and into each space 318 between strips 316, as well as into the grooves which form the narrow portion 322. When set within these 322 narrow portion-grooves, the molded material 319 serves to hold each separated strip-pad 320 effectively in place against centrifical forces generated during a turning-type machine finishing operation for the roll 40. This allows for precision machine finishing of the dielectric strips 319 and the washer strips 316 into commutator pads 320.

In order to make the donor roll 40 of the present invention, the centrally formed opening 312 of the washer device 302 is initially placed over the shaft core 153. The shaft core and the washer are then staged concentrically within a mold, preferably and injection mold. The outer portion 304 of the washer device 302 is inserted into a retention groove of the injection mold, and molding plastic material suitable for forming the dielectric layer 154 is then injection molded over the shaft core 153 as well as over and around the washer device 302. When the plastic material is injected into the mold cavity, it flows over the aluminum shaft core 153, through the opening 312, the slots 314 and spaces 318 in the washer 302, and overmolds the washer completely into the plastic layer 154 of the roll 40.

After such overmolding, the roll 40 with the washer device 302 overmolded therein, are machined to a desired finished outer diameter equal to D4, and to an inner recess 325 at commutator end that has a diameter D5 (FIG. 5). Diameters D4 and D5 are such as to effectively expose outer tips or ends 324 and inner tips 326 of each commutator pad 320 in the layer 154. Each commutator pad 320 is what is left of each strip 316 of the washer device 302 following such machining. More importantly, the end of the layer 154 of donor roll 40 can also be machined backwards from the journal end until each contact pad 320 has a radially extending exposed surface 330 (FIGS. 1 and 4) so as to enable robust end commutation. The roll 40 is then processed for adding on its surface, electrode wires 42 in any well known manner such that each electrode wire 42 is lined up with, as well as contacts, a robust commutator pad 320. As shown in FIGS. 1 and 2, a conductive brush 115 for example, biased by a power supply is mounted to contact the pads 320 as the roll 40 rotates to commutate bias through the wires 42.

As can be seen, a donor roll 40 including robust commutator pads or contacts 320 formed from the machined strips 316 of the washer device 302 clearly will not have the disadvantages of wear and tear on, as well as, contamination of plated electrode contacts, as are encountered commonly with conventional donor rolls. The desirable results from the donor roll of the present invention therefore include little or no wear and tear, no pitting, a relatively extended life, and relatively greater reliability in commutation.

In addition, as clearly shown in FIG. 4, the exposed outer tips 324 and exposed inner tips 326 of each overmolded contact pad 320 desirably allows for alternative internal commutation to the inner tips 326, or external commutation to the outer tips 324. Internal commutation as such is achieved by machining away the entire inner portion 306 of the washer device 302 to expose the separated tips of each strip 316 from the inside of the layer 154. A brush such as 115 can then be located in the inside of the machined layer 154, thus saving space on the outside of a mounted roll 40.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A development unit for developing a latent image recorded on an image bearing member, the development unit comprising:

(a) a housing defining a mixing chamber for mixing and charging a supply of magnetizable two-component developer material containing charged toner particles;

(b) means mounted within said mixing chamber for moving developer material thereabout; and (c) a rotatable electroded donor roll mounted partially within said mixing chamber for forming a development zone with an image bearing member, said donor roll being rotatable to move charged toner particles from said mixing chamber to the development zone, and said donor roll including:

(i) a conductive shaft core;

(ii) a dielectric layer injection molded over said shaft core;

(iii) axially extending electrodes formed on a surface of said dielectric layer; and (iv) robust commutator contact pads formed from a conductive commutator washer device overmolded into said dielectric layer, said commutator pads each contacting an axially extending electrode.

2. The development unit of claim 1, wherein said robust commutator contact pads are formed from spoke-like strips interconnecting an outer portion and an inner portion of the overmolded commutator washer, by machining away the outer and inner portions of the washer after such overmolding.

3. The development unit of claim 2, wherein said robust commutator contact pads as formed each includes an exposed outer contact area on the surface of the dielectric layer, and an exposed contact area within a recess between the dielectric layer and said shaft core.

4. The development unit of claim 2, wherein said robust commutator contact pads each include an exposed donor roll end contact area extending radially at the end of said dielectric layer, said end contact area being formed by machining away dielectric material and exposing an otherwise overmolded surface of a washer strip.

5. The development unit of claim 2, wherein said robust commutator contact pads each include a first exposed outer contact area on the surface of the dielectric layer, a second exposed outer contact area within a recess between the dielectric layer and said shaft core, and a third exposed outer contact area extending radially at an end of said dielectric layer.

6. An electroded donor roll for mounting partially within a mixing chamber of a development unit and forming a development zone with an image bearing member to move charged toner particles from the mixing chamber to the development zone, said donor roll comprising:

(i) a conductive shaft core;

(ii) a dielectric layer injection molded over said shaft core;

(iii) axially extending electrodes formed in a surface of said dielectric layer; and (iv) robust commutator contact pads formed from a conductive commutator washer device overmolded into said dielectric layer, said commutator pads each contacting an axially extending electrode.

7. The donor roll of claim 6, wherein said robust commutator contact pads are formed from spoke-like strips interconnecting an outer portion and an inner portion of the overmolded commutator washer, by machining away the outer and inner portions of the washer after such overmolding.

8. The donor roll of claim 7, wherein said robust commutator contact pads as formed, each includes an exposed outer contact area on the surface of the dielectric layer, and an exposed contact area within a recess between the dielectric layer and said shaft core.

9. The donor roll of claim 7, wherein said robust commutator contact pads each include an exposed donor roll end contact area extending radially at an end of said dielectric layer, said donor roll and contact area being formed by machining away dielectric material and exposing an otherwise overmolded surface of a washer strip.

10. The donor roll of claim 7, wherein said robust commutator contact pads each include a first exposed outer contact area on the surface of the dielectric layer, a second exposed outer contact area within a recess between the dielectric layer and said shaft core, and a third exposed outer contact area extending radially at an end of said dielectric layer.

* * * * *